US005713275A

United States Patent [19]

Imai

[11] Patent Number: 5,713,275

[45] Date of Patent: Feb. 3, 1998

[54] STENCIL PRINTING MACHINE

[75] Inventor: Ryoichi Imai, Ibaraki-ken, Japan

[73] Assignee: Riso Kagaku Corporation, Tokyo, Japan

[21] Appl. No.: 659,564

[22] Filed: Jun. 10, 1996

[30] Foreign Application Priority Data

Jun. 19, 1995 [JP] Japan ..... 7-151926

[51] Int. Cl.[6] ..... B41L 13/06

[52] U.S. Cl. ..... 101/119; 101/124; 118/301

[58] Field of Search ..... 101/114, 115, 101/116, 118, 119, 120, 123, 124, 127.1; 118/300, 301, 317

[56] References Cited

U.S. PATENT DOCUMENTS 4,444,104 4/1984 Mitter ..... 101/119

5,090,312 2/1992 Ohinata ..... 101/120

5,375,516 12/1994 Hasegawa ..... 101/116

5,389,148 2/1995 Matsunaga ..... 101/119

FOREIGN PATENT DOCUMENTS 0653310 5/1995 European Pat. Off. .

*Primary Examiner*—Ren Yan

*Attorney, Agent, or Firm*—Kanesaka & Takeuchi

[57] ABSTRACT

A stencil printing machine includes a holding device for holding a stencil sheet perforated in accordance with an image; an ink supply device for supplying ink to one face side of the stencil sheet held by the holding means; a printing sheet conveying device for conveying a printing sheet in a predetermined direction near an opposite face side of the stencil sheet; and an air ejection means for ejecting air to the stencil sheet from the one face side of the stencil sheet and thereby causing the ink to pass through the image in the stencil sheet and transfer onto the printing sheet.

11 Claims, 14 Drawing Sheets

STENCIL PRINTING MACHINE

BACKGROUND OF THE INVENTION

The present invention relates to a stencil printing machine which utilizes a discharge force of air for the transfer of ink from a stencil sheet onto a printing sheet to effect printing.

A conventional stencil printing machine suitable for printing a large number of printing sheets is provided as a principal part of printing means with a cylindrical printing drum which is driven for rotation about its own axis. At least a portion of the peripheral surface of the printing drum serves as an ink-permeable printing area, and a perforated stencil sheet is wound around the outer peripheral surface of the printing drum. In the interior of the printing drum is disposed an ink supply means to supply ink to the inner peripheral surface of the printing drum. Outside the printing drum is disposed an urging means such as a roller for example to hold each printing sheet between it and the printing drum when the sheet is fed. With the printing sheet thus held, stencil printing is performed.

In the case where multicolor printing is to be performed in the conventional stencil printing machine having the above basic construction, it is necessary to replace the printing drum with another printing drum for each color (for each of four colors if the printing is a full color printing) and perform a multicolor overprint on each printing sheet. In this case, the printing drums used are supplied with inks of different colors respectively, and stencil sheets perforated according to the colors are wound around the printing drums.

The printing drum has a weight of, say, 10 kg and the work of replacing it for each of different printing colors in the stencil printing machine requires a sufficient physical strength. Besides, the printing work involving such replacement of printing drums is required to wait for drying of ink on each printing sheet used as a different color of ink in the previous step, thus requiring a long time. If a printing drum with ink of the next color is loaded to the stencil printing machine and printing is started prior to drying of the ink applied to the printing sheet in the preceding step, the color ink applied to the printing sheet in the preceding step will be transferred to the stencil sheet wound around the printing drum to the inner peripheral surface of which is supplied ink of a different color to be used in the next step, resulting in mixing of both colors and causing the problem that the printed image becomes very dirty.

Particularly, in the conventional stencil printing machine, a printing sheet is pushed at a predetermined pressure against a stencil sheet supplied with ink and the ink forced out from an image portion of the stencil sheet is transferred onto the printing sheet to effect printing. Thus, according to the conventional stencil printing machine, the printing sheet is conveyed while being kept in contact with the stencil sheet at a considerable pressure, thus often resulting in that a force acting to disturb the printed image is applied to the printing surface of the printing sheet. For this reason it has heretofore been impossible to avoid the foregoing inconveniences involved in multicolor printing.

It is an object of the present invention to provide a stencil printing machine in which the application of an unnecessary force to the printing surface of a printing sheet is avoided as little as possible at the time of transfer of ink from a stencil sheet onto the printing sheet in stencil printing and which therefore can afford a beautiful print and is suitable to multicolor printing for example.

SUMMARY OF THE INVENTION

The stencil printing machine according to a first aspect of the present invention is provided with a holding means for holding a stencil sheet perforated in accordance with an image, an ink supply means for supplying ink to face side of the stencil sheet which is held by the holding means, a printing sheet conveying means for conveying a printing sheet near the other face side of the stencil sheet, and an air ejection means for ejecting air to the stencil sheet from the one face side thereof, thereby causing the ink to pass through the image on the stencil sheet and transfer onto the printing sheet.

In the stencil printing machine according to a second aspect, which is dependent on the first aspect, the holding means is provided with an ink-permeable body adapted to move in a predetermined direction while holding the stencil sheet in contact with the one face side of the stencil sheet.

In the stencil printing machine according to a third aspect, which is dependent on the second aspect, the body is a cylindrical, circumferential wall at least a part of which has ink permeability, and the holding means is a printing drum having the said circumferential wall and adapted to be driven for rotation about the axis thereof.

In the stencil printing machine according to a fourth aspect, which is dependent on the second aspect, the air ejection means has an air ejection aperture which is in contact with the inner surface of the body.

In the stencil printing machine according to a fifth aspect, which is dependent on the fourth aspect, the air ejection aperture is a slit substantially parallel to the moving direction of the body, and the width thereof in the direction substantially perpendicular to the moving direction of the body is larger than the diameter of each of pores which constitute the image on the stencil sheet.

The stencil printing machine according to a sixth aspect, which is dependent on the second aspect, is further provided with a suction means disposed near the other face side of the stencil sheet held by the holding means, the suction means sucking the printing sheet being conveyed by the printing sheet conveying means to create a predetermined spacing between the printing sheet and the stencil sheet.

The stencil printing machine described according to a seventh aspect, which is dependent on the sixth aspect, is further provided with an air compressor means which supplies compressed air to the air ejection means and which sucks air from the suction means.

The stencil printing machine according to an eighth aspect, which is dependent on the seventh aspect, is further provided with a pulsative compressed air generating means for making the compressed air supplied from the air compressor means into pulsative and supplying the pulsative compressed air to the air ejection means.

In the stencil printing machine according to a ninth aspect, which is dependent on the eighth aspect, the pulsative compressed air generating means is provided with a rotating disc having slits communicating with the air compressor means side and also provided with a fixed disc which is in contact with the rotating disc and which has slits communicating with the air ejection means side.

The stencil printing machine in accordance with a tenth aspect is provided with a pair of belts disposed movably at a predetermined spacing from each other for holding and conveying a stencil sheet perforated according to an image, an ink supply means for supplying ink to one face of the stencil sheet held by the belts, a printing sheet conveying means for conveying a printing sheet in a predetermined direction near the other face side of the stencil sheet, and an air ejection means for ejecting air to the said one face of the stencil sheet and thereby causing the ink to pass through the image on the stencil sheet and transfer onto the printing sheet.

The stencil printing machine in accordance with an eleventh aspect is provided with a holding means for holding a stencil sheet perforated in accordance with an image, an ink supply means for supplying ink to the stencil sheet from one face side of the stencil sheet held by the holding means, a printing sheet conveying means for conveying a printing sheet in a predetermined direction near the other face side of the stencil sheet, and an air ejection means for ejecting air to the stencil sheet from the one face side of the stencil sheet and thereby causing the ink to pass through the image on the stencil sheet and transfer onto the printing sheet, a plurality of such stencil printing machines being provided for different kinds of inks respectively and arranged side by side in the predetermined conveyance direction of the printing sheet.

According to the above constructions there are obtained at least the following operations.

A part of ink supplied to the body by the ink supply means is retained in the image portion on the stencil sheet held by the body. Air ejected from the air ejection means is applied to the stencil sheet and causes the ink retained in the image portion of the stencil sheet to be separated from the stencil sheet. The printing sheet is conveyed by the printing sheet conveying means while being sucked by the suction means to maintain a predetermined spacing between it and the stencil sheet. The ink which has left the stencil sheet under the ejection of air from the air ejection means transfers onto the printing sheet spaced from the stencil sheet to form a printed image on the printing sheet. The air compressor means sucks the printing sheet through the suction means. When the slits of the rotating disc and the slits of the fixed disc in the pulsative compressed air generating means come into alignment with each other, the compressed air from the air compressor means passes through the slits of both discs and becomes a pulsative compressed air, which is supplied to the air ejection means.

BRIEF DESCRIPTION OF THE DRAWINGS

FIG. 14(*b*) is a perspective view of an air nozzle in the second embodiment;

FIG. 14(*c*) is a perspective view of an air nozzle in the third embodiment;

DETAILED DESCRIPTION OF THE PREFERRED EMBODIMENTS

Figure 1:
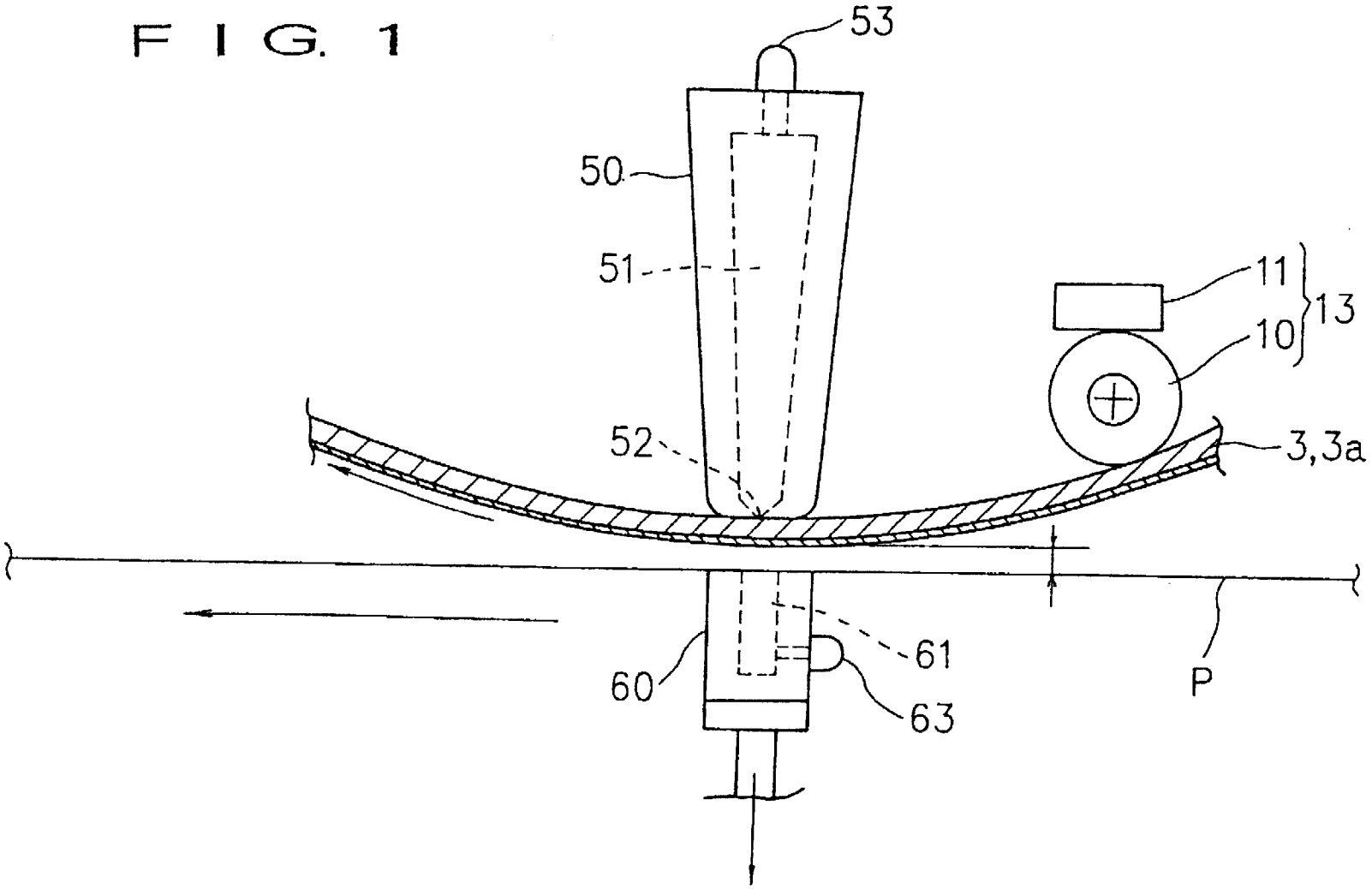
FIG. 1 is an enlarged sectional view of an air nozzle and the vicinity thereof in the first embodiment.

The construction of a stencil printing machine 1 according to an embodiment of the present invention will be described with reference to FIGS. 1 to 7. Description will first be directed to the construction of each component of the stencil printing machine 1 with reference to FIG. 3. In FIG. 3, the reference numeral 3 denotes a printing drum which serves as a holding means for holding a stencil sheet S. The printing drum 3 is provided with a circumferential wall 3*a* as a body having an ink-permeable printing area of a porous structure. A stencil sheet clamping device 4 for selectively clamping one end portion of the stencil sheet S is mounted to a part of the outer peripheral surface of the circumferential wall 3*a*. The printing drum 3 is rotated clockwise (in the figure) about its own axis by a drive means such as an electric motor (not shown) or the like. The stencil sheet S clamped at one end portion thereof to the printing drum 3 by the stencil clamping device 4 is wound around the outer peripheral surface of the printing drum by virtue of the viscosity of printing ink.

The stencil clamping device 4 has two magnet plates 6 and 7 fixed to a stencil sheet mounting seat portion 5 formed on the outer peripheral surface of the printing drum 3 and also has a clamp piece 9 which is constituted by a metallic sheet and which is pivotally secured at one end portion thereof to the seat portion 5 through a pivot shaft 8. When the clamp piece 9 is attracted magnetically by the magnet plate 7, one end portion of stencil sheet S is clamped on the printing drum 3 by both clamp piece 9 and magnet plate 7. The clamp piece 9 is pivotally moved by a drive unit (not shown) to clamp and unclamp the stencil sheet S automatically between a clamp position in which the clamp piece 9 is magnetically attracted to the magnet plate 7 as illustrated in the figure and an unclamp position in which the clamp piece 9 is magnetically attracted to the other magnet plate 6 as indicated in phantom. If a more detailed description of the stencil sheet clamping device 4 is necessary, it can be found in the specification and drawings of Japanese Patent Laid Open No. 96984/84 (Application No.207217/82) filed by the applicant in the present case.

In the interior of the printing drum 3 is disposed an ink supply means 13 which includes a squeegee roller 10 and an ink feeder 11. In accordance with rotation of the printing drum 3 the ink supply means 13 supplies a printing ink to the inner peripheral surface of the circumferential wall 3*a* of the printing drum. The ink fed to the inner peripheral wall of the circumferential wall 3*a* by the ink supply means 13 is retained in the wall 3*a* which is permeable to ink and is also retained in a large number of fine holes which constitute the image portion of the stencil sheet S held on the outer peripheral surface of the circumferential wall 3*a*.

On one side of the printing drum 3 is disposed a stencil sheet storage section 14, which stores the stencil sheet S in the form of a continuous rolled sheet.

Between the stencil sheet storage section 14 and the printing drum 3 is disposed a stencil making device 2, which has a thermal head 15 as a heat-sensitive perforator and a platen roller 16. The stencil sheet S is fed from the stencil sheet storage section 14 to the stencil making device 2, which in turn perforates the stencil sheet. The image portion of the stencil sheet S thus perforated is constituted by a gathering of many fine pores formed by thermal perforation.

A stencil sheet stocker 17 is disposed between the stencil making device 2 and the printing drum 3. The stencil sheet stocker 17 has a stencil sheet stock portion 18 capable of temporarily storing the stencil sheet perforated by the stencil making device 2 and also capable of storing meanderingly the stencil sheet S at a length corresponding to a considerable number of stencil sheets which have been perforated, a stencil sheet lead-in roller 19 for feeding the stencil sheet S from the stencil making device 2 into the stencil sheet stock portion 18, and a stencil sheet delivery roller 20 for delivery of the stencil sheet S from the stencil sheet stock portion 18 to a stencil sheet cutting device 21 which will be described later.

Between the stencil sheet delivery roller 20 in the stencil sheet stocker 17 and the printing drum 3 is disposed a stencil sheet cutting device 21. The stencil sheet cutting device 21 is provided with a cylindrical rotary blade 23 having a spirally edged portion on its outer peripheral portion and also provided with a flat blade 24 which is in contact with the rotary blade 23. The stencil sheet S is cut by both blades 23 and 24.

On the side opposite to the stencil making device 2 with respect to the printing drum 3 is disposed a stencil sheet discharging device as a stencil sheet discharging means. The stencil sheet discharging device 25 peels the stencil sheet which has already been used from the printing drum 3 and discharges it into a stencil sheet discard box which will be described later. The stencil sheet discharging device 25 has a pair of rollers 26, a stencil sheet peeling pawl 27 and a stencil sheet discard box 28.

The paired rollers 26 comprise a metallic roller 29 and a rubber roller 30 carried respectively on lower and upper rotating shafts which are disposed at an inlet portion of the stencil sheet discard box 28 so as to be parallel to the axis of the printing drum 3, the rollers 29 and 30 being engaged with each other. The metallic roller 29 is rotated clockwise in the figure by means of an electric motor 31. As shown in the figure, on the side opposite to the stencil sheet cutting device 21 the paired rollers 26 are positioned extremely close to the stencil sheet clamping device 4 on the printing drum 3 which device is in the stencil sheet loading/discharge position.

The stencil sheet peeling pawl 27 is pivotally supported at a base end portion thereof by a pivot shaft 32, and an end portion thereof on the side opposite to the tip end of the pawl with respect to the pivot shaft 32 is drivingly connected to a plunger of a solenoid device 33. Thus, the stencil sheet peeling pawl 27 is pivotally moved between the stencil sheet peeling position illustrated and a stand-by position turned clockwise about the pivot shaft 32 from the stencil sheet peeling position.

In a position above the printing drum 3 and for contact with the clamp piece 9 which moves pivotally in the stencil sheet loading/discharge position illustrated there is disposed a stencil sheet guide member 40 (hereinafter referred to as the guide member 40) which is adapted to shift following the pivotal motion of the clamp piece 9. The guide member 40 can be deformed or move without obstructing the pivotal motion of the clamp piece 9. The guide member 40 used in this embodiment is constituted by a flexible member and is deformed as the clamp member 9 moves pivotally. The guide member 40 is in the form of a single plate having a width larger than that of the clamp piece 9. One edge portion of the guide member 40 on the stencil sheet cutting device 21 side is fixed to a case 23*a* of the rotary blade 23, while an opposite edge portion thereof on the stencil sheet discharging device 25 side is movable without being fixed in the stencil sheet discard box 28.

In the interior of the printing drum 3 is disposed an air nozzle 50 as an air ejection means for blowing off the ink retained in the stencil sheet S by virtue of an air pressure and allowing it to transfer onto a printing sheet. As shown in FIGS. 1, 3, 4 and 14(*a*), the air nozzle 50 is a generally wedge-shaped hollow box, and in the interior thereof is formed a space which serves as an air chamber 51. The air chamber 51 is open to an elongated slit-like air ejection aperture 52 formed in the lower end of the air nozzle 50. The longitudinal direction of the air ejection aperture 52 is parallel to the rotating shaft or cylindrical generatrices of the printing drum 3. The length of the air ejection aperture 52 in the direction parallel to the rotating shaft of the printing drum 3 corresponds to the length in the axial direction of the printing drum. The width of the air ejection aperture 52 in the direction perpendicular to the longitudinal direction is preferably larger than the diameter of each pore as a constituent of the image portion of the stencil sheet S; for example, it is in the range of 0.1 to 0.3 mm.

The air ejection aperture 52 is in contact under an appropriate contact force with the inner peripheral surface of the circumferential wall 3*a* of the printing drum 3 located in the bottom position. Consequently, the air ejected from the air nozzle 50 is blown into the circumferential wall 3*a* without leakage thereof to the interior space of the printing drum and the rotation of the printing drum is not obstructed by the air nozzle 50. The air chamber 51 in the air nozzle 50 is connected to an air compressor means which will be described later through a duct 53 communicating with the upper end of the air chamber. Compressed air fed into the air chamber 51 from the air compressor means passes through the air ejection aperture 52 into the circumferential wall 3*a*.

Below the printing drum 3 are provided a plurality of guide plates 55 which constitute a conveyance surface for the printing sheet indicated at P. In both side positions of the printing drum 3 close to the guide plates 55 are disposed timing rollers 56 and feed rollers 57 as printing sheet conveying means. In synchronism with rotation of the printing drum 3 the timing rollers 56 deliver the printing sheet P to the space below the printing drum. The printing sheet P is conveyed below the printing drum by means of both timing rollers 56 and feed rollers 57. As shown in FIG. 3, on the right-hand side in the same figure of the timing rollers 56 in the conveyance direction of the printing sheet P is disposed a sensor 58 for detecting the position of the printing sheet P.

Under the circumferential wall 3*a* of the printing drum 3 located in the bottom position is disposed a suction nozzle 60 as a suction means at a predetermined spacing from the circumferential wall. The suction nozzle 60 is a box having a length corresponding to the axial length of the printing drum 3, and in an upper surface thereof opposed to the printing drum there opens a slit-like suction aperture 61 in parallel with cylindrical generatrices of the printing drum. The suction nozzle 60 is connected to a solenoid 62 serving as a drive means. At the time of printing when the printing sheet P is conveyed along the guide plates 55, the suction nozzle 60 is set to a position in the conveyance plane. When the stencil sheet clamping device 4 reaches the bottom position with rotation of the printing drum 3, the suction nozzle 60 shifts to a lower position to avoid interference with the stencil sheet clamping device. The suction nozzle 60 is connected through a duct 63 to an air suction side of an air compressor means which will be described later. With the suction nozzle 60 set in the conveyance plane of the printing sheet P, if the air compressor means sucks air from the suction nozzle with compression of air, the printing sheet P being conveyed is sucked by the suction nozzle 60, so that the spacing between the printing sheet and the printing drum 3 is maintained constant. Upon lapse of a predetermined time after sensing the printing sheet P by the sensor 58, and after arrival of the printing sheet front end at the feed rollers 57, the suction nozzle 60 starts suction.

Figure 2:
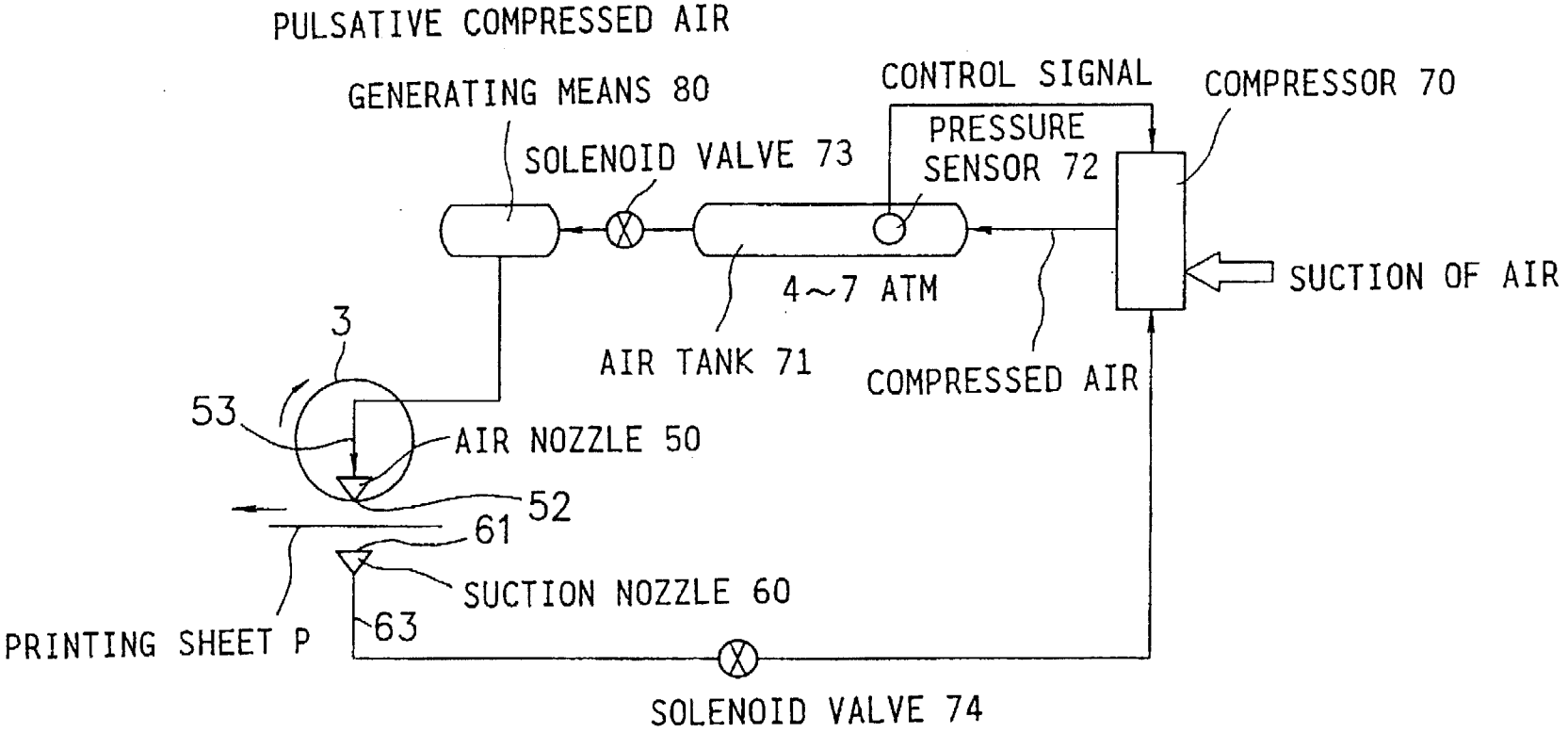
FIG. 2 is an air pressure circuit diagram in the first embodiment.
Figure 3:
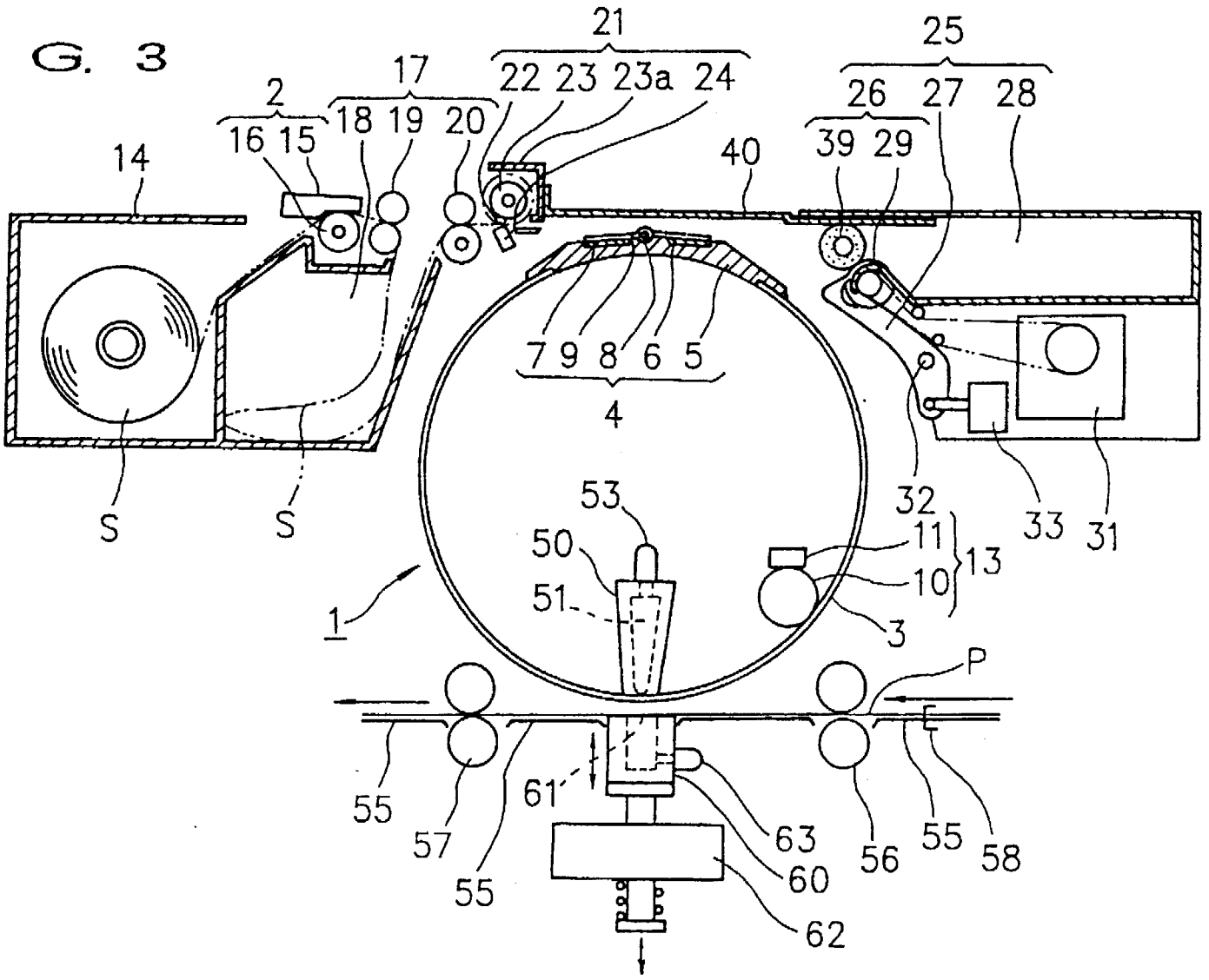
FIG. 3 is a sectional view showing an entire construction of the first embodiment.
Figure 4:
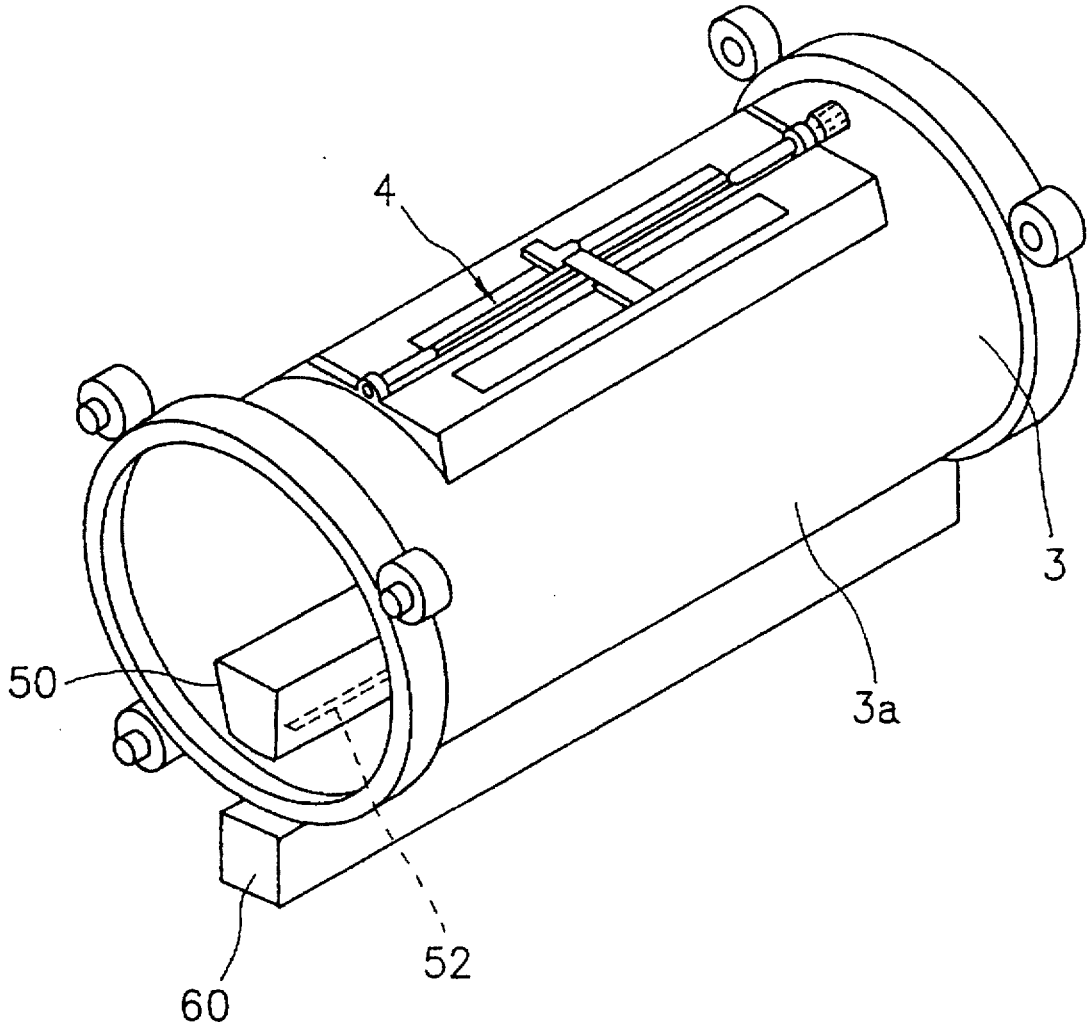
FIG. 4 is a perspective view of a printing drum and the vicinity thereof in the first embodiment.

FIG. 2 shows the construction of an air pressure circuit used in this embodiment. Compressed air generated by a compressor as the air compressor means is fed into an air tank 71 as a pressure accumulator means. In this embodiment the pressure of compressed air in the air tank 71 is set at 4–7 atm. Within the air tank 71 is disposed a pressure sensor 72. A control signal responsive to the sensing result in the pressure sensor 72 is used to control the operation of the compressor 70. Compressed air in the air tank 71, whose pressure is maintained in the predetermined range, passes through a solenoid valve 73 adapted to open and close as necessity and is then converted to a pulsative compressed air by a pulsative compressed air generating means 80, which pulsative compressed air is fed to the air nozzle 50, which in turn ejects the pulsative compressed air into the circumferential wall 3*a* of the printing drum 3.

A part of the suction side of the compressor 70 is connected to the duct 63 of the suction nozzle 60 through a solenoid valve 74 adapted to open and close as necessity. The suction nozzle 60 sucks the printing sheet P by suction of air to prevent fluttering of the printing sheet during feed of the same sheet and keep constant the spacing between the air nozzle 50 located within the printing drum 3 and the printing sheet P located below the drum.

Figure 5:
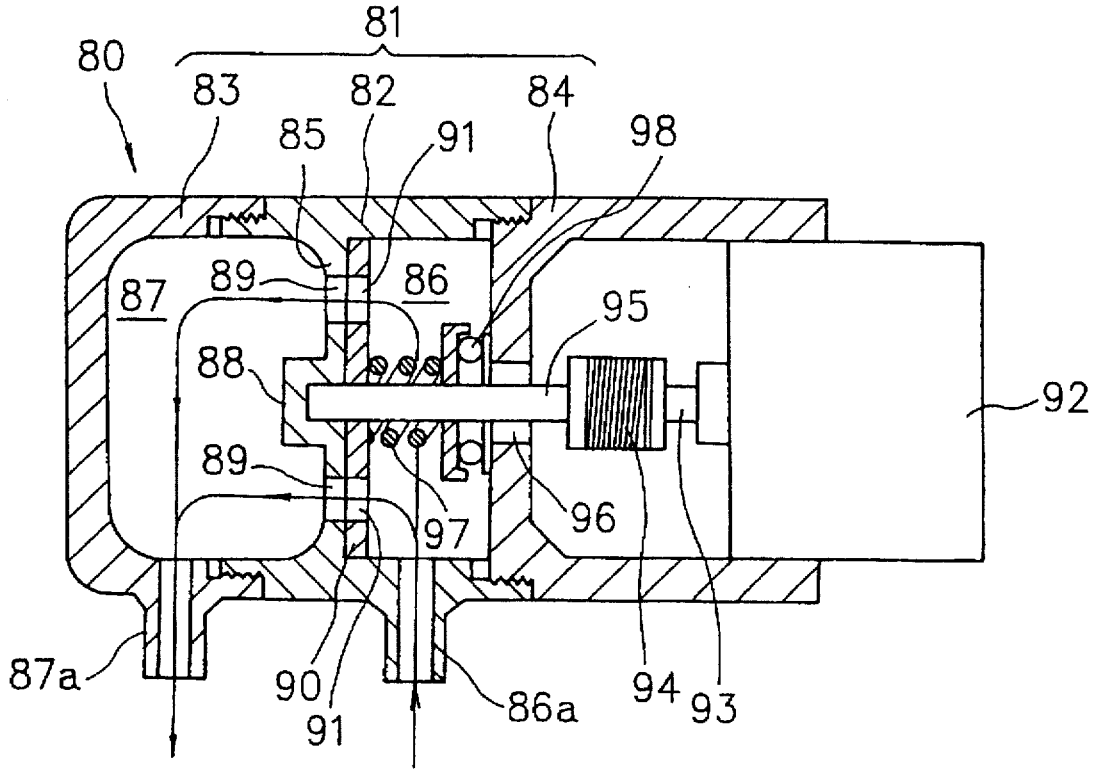
FIG. 5 is a sectional view of a pulsative compressed air generating means in the first embodiment.
Figure 6:
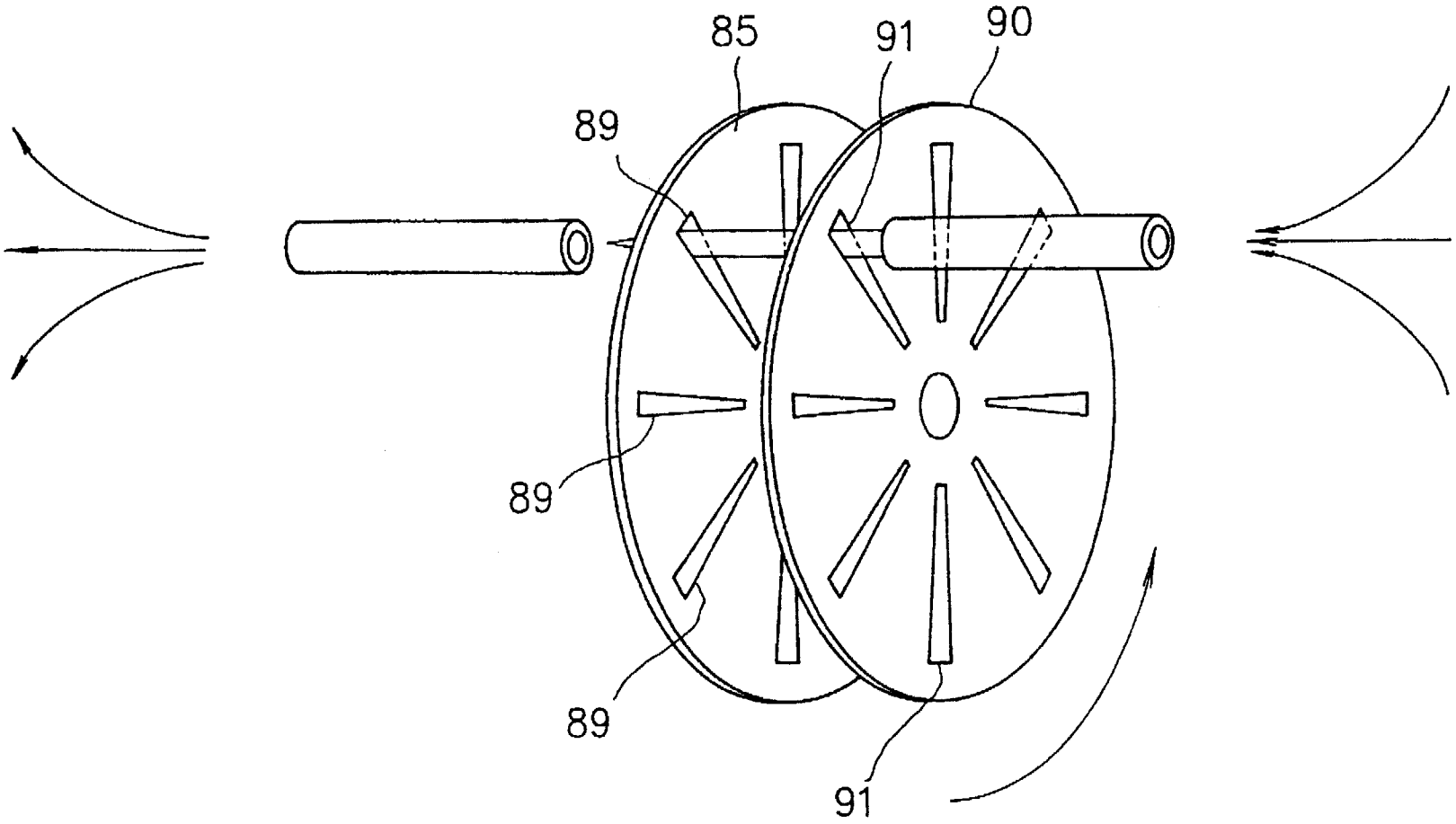
FIG. 6 is a perspective view showing the principle of the pulsative compressed air generating means in the first embodiment.

FIG. 5 is a sectional view showing the construction of the pulsative compressed air generating means 80, and FIG. 6 is a perspective view showing schematically a principal portion of the pulsative compressed air generating means 80. A cylindrical housing 81 comprises a body 82 having a fixed disc 85, one closure member 83 fixed hermetically to one end of the body 82, and the other closure member 84 fixed hermetically to the other end of the body 82. The interior of the housing 81 is divided into an air supply chamber 86 which is defined by the body 82 and the other closure member 84 and an exhaust chamber 87 which is defined by the body 82 and one closure member 83. The air supply chamber 86 has an intake pipe 86*a* connected to the discharge side of the compressor 70, while the exhaust chamber 87 has an exhaust pipe 87*a* connected to the air nozzle 50.

The fixed disc 85 is centrally formed with a bearing portion 88 which is recessed on the air supply chamber 86 side. In the fixed disc 85 are formed a plurality of slits 89 around the bearing portion 88. The slits 89 are long in the radial direction of the fixed disc 85 and are formed at predetermined rotational angle intervals in the circumferential direction of the fixed disc.

In the interior of the air supply chamber 86, a rotating disc 90, which is about the same in shape as the fixed disc 85, is in contact with the fixed disc. The rotating disc 90 also has slits 91 of the same structure as the slits of the fixed disc 85.

To the other closure member 84 of the housing 81 is fixed a motor 92 as a drive means. A drive shaft 95 is connected to a rotating shaft 93 of the motor 92 through a universal joint 94. The drive shaft 95 extends through the other closure member 84 through a bearing 96. In the interior of the air supply chamber 86, the front end of the drive shaft 95 is fixed to the center of the rotating disc 90 and is supported rotatably by the bearing portion 88 of the fixed disc 85. Further, within the air supply chamber 86, a spring 97 is fitted on the drive shaft 95. Between the spring 97 and the other closure member 84 is interposed a ball bearing 98. By virtue of the spring 97 the rotating disc 90 comes into contact at an appropriate force with the fixed disc 85.

The rotating disc 90 is rotated by operation of the motor 92. The compressor 70 feeds compressed air into the air supply chamber 86 through the intake pipe 86*a*. The air supply chamber 86 and the exhaust chamber 87 come into communication with each other only when the slits 91 and 89 of the rotating disc 90 and the fixed disc 85, respectively, are aligned with each other, and the compressed air shifts from the air supply chamber 86 into the exhaust chamber 87. That is, the air current from the air supply chamber 86 to the exhaust chamber 87 is turned on and off according to the rotation of the rotating disc 90 relative to the fixed disc 85.

Figure 7:
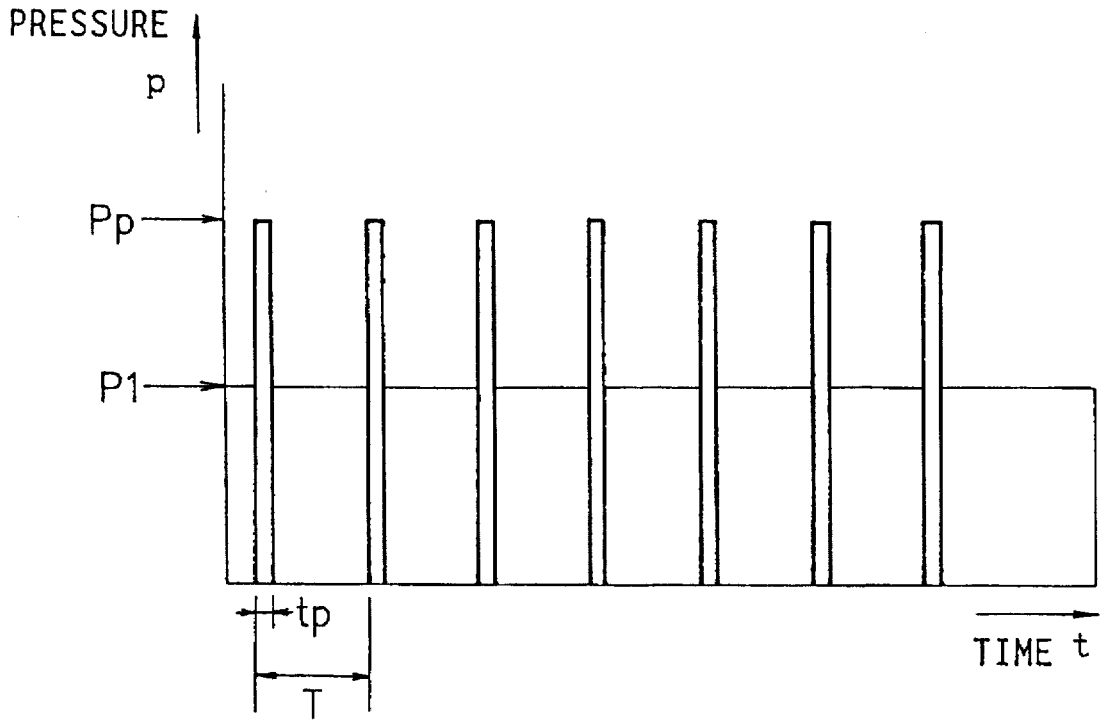
FIG. 7 is a waveform diagram of a pulsative compressed air generated by the pulsative compressed air generating means in the first embodiment.

As a result, the air pressure of the compressed air fed from the exhaust pipe 87*a* of the exhaust chamber 87 to the air nozzle 50 assumes a waveform having such a pulsative peak Pp as shown in FIG. 7. The pulse period T (time T) shown in FIG. 7 depends on the number of revolutions of the rotating disc 90 and the number of slits 89 and 91. Further, a duty ratio $\Delta t/T$ can be changed by changing the opening width of the slits 89 and 91. The aforesaid pulse waveform is determined by the total area of the aligned slits 91 and 89 of the rotating disc 90 and fixed disc 85, respectively. Further, the longer and thinner the slits 89 and 91 in the radial direction of rotation, the sharper the pulse waveform, even when the aforementioned area remains the same.

In the case where printing is performed at a resolution of 400 dpi and at a speed of 20 A4-size printing sheets P per minute, using the stencil printing machine 1 of this embodiment, the required pulse period is as follows. The above resolution means that printing is conducted so as to permit resolving of 400 lines within 25 mm. Therefore, if adjacent lines are overlapped half in a printing area of A4-size printing sheet P, it is necessary to make ejection of ink (namely the ejection of air) about 9,000 times for each A4-size printing sheet P. If 20 sheets are printed per minute, namely one sheet is printed in 3 seconds, it is necessary to make ejection of ink (namely the ejection of air) about 9,000 times during the period of 3 seconds, namely at a frequency of 3,000 Hz.

If a pulsative compressed air is utilized, there no longer is any waste in the utilization of compressed air because the air using period is limited to only a period of a short time tp. Besides, the instantaneous force at the rising edge of air pressure can be increased by suitably setting the pulse duration tp, whereby the force for blowing off the ink retained in the stencil sheet S can be enhanced.

Reference will be made below to the operation of this embodiment constructed as above.

The stencil sheet S is perforated by the stencil making device 2. The front end of the stencil sheet S is clamped by the stencil sheet clamping device 4 and the sheet is wound around the printing drum 3. Once printing is started, the printing sheet P fed from a printing sheet tray (not shown) is conveyed while being synchronized with the rotation of the printing drum 3 by means of the timing rollers 56. Upon lapse of a predetermined time after sensing the printing sheet P in a position just before the timing rollers 56 by the sensor 58, and after arrival of the front end of the printing sheet at the feed rollers 57, the suction nozzle 60 starts suction and sucks the printing paper. The printing paper P is sucked by the suction nozzle 60 to keep constant the spacing from the outer peripheral surface of the printing drum 3 and in this state it is conveyed by the feed rollers 57.

The above conveyance motion of the printing sheet P and the rotating motion of the printing drum 3 are in synchronism with each other, and the printing area of the stencil sheet S rotating together with the printing drum 3 corresponds to the area to be printed of the printing sheet P being conveyed. While the printing area of the stencil sheet S passes below the air nozzle 50, the solenoid valve 73 operates, whereby the compressed air in the air tank 71 is supplied to the pulsative compressed air generating means 80 and a pulsative compressed air is ejected from the air ejection aperture of the air nozzle 50.

Figure 8:
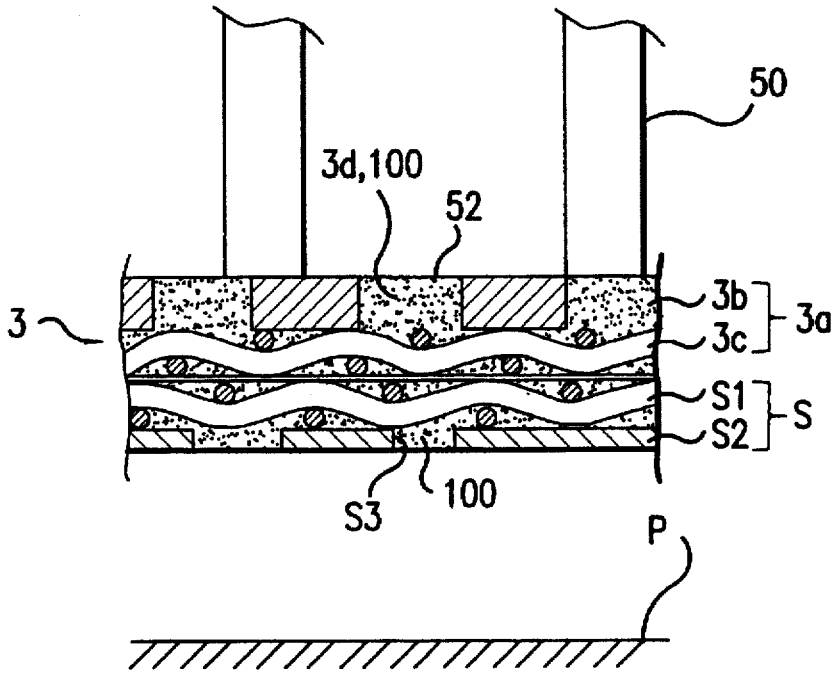
FIG. 8 is a sectional view showing an ink ejecting operation of an air nozzle in the first embodiment.

As the printing drum 3 rotates, the ink supply means 13 supplies ink 100 to the inner surface of the circumferential wall 3*a* of the printing drum. The ink 100 thus fed to the inner surface of the circumferential wall 3*a* is retained in both interior space of the ink-permeable circumferential wall and interior space of the stencil sheet S. As shown in FIG. 8, the circumferential wall 3*a* used in this embodiment comprises a body 3*b* formed with a large number of pores 3*d* and having a predetermined rigidity and a screen mesh 3*c* wound round the outer peripheral surface of the body 3*b*. The ink 100 is filled into the pores 3*d* of the body 3*b* and also into the gaps of the screen mesh 3*c*. The stencil sheet S used in this embodiment, as shown in FIG. 8, is constituted by a laminate of a porous substrate S1 and a photosensitive resin film S2 which is thermally perforated, the porous substrate S1 being, for example, paper produced from natural or synthetic fibers or the like alone or a mixture thereof or gauze produced from synthetic fibers or the like alone or a mixture thereof. The ink 100 is retained in interior interstices of the porous substrate S1.

Figure 9:
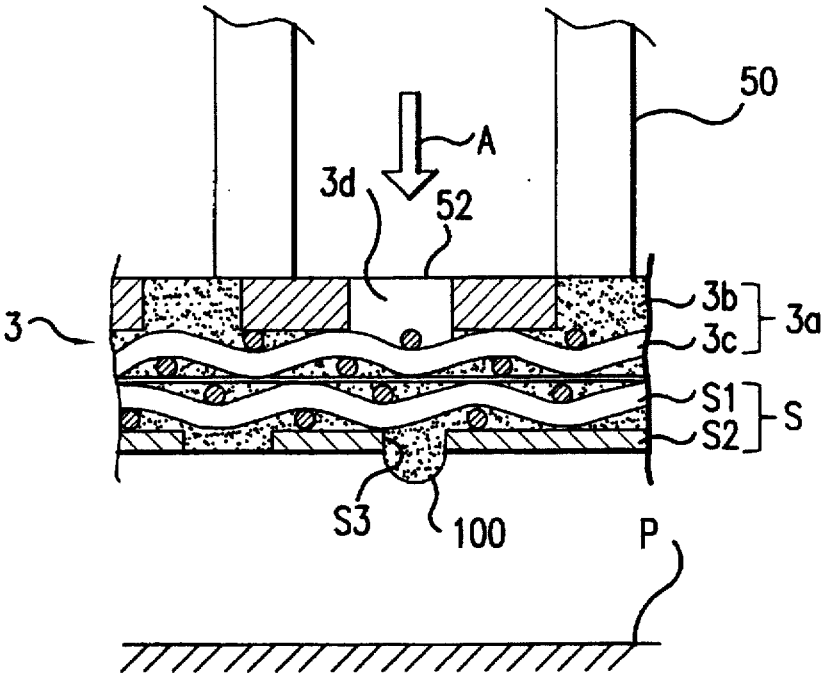
FIG. 9 is a sectional view showing an ink ejecting operation of the air nozzle in the first embodiment.
Figure 10:
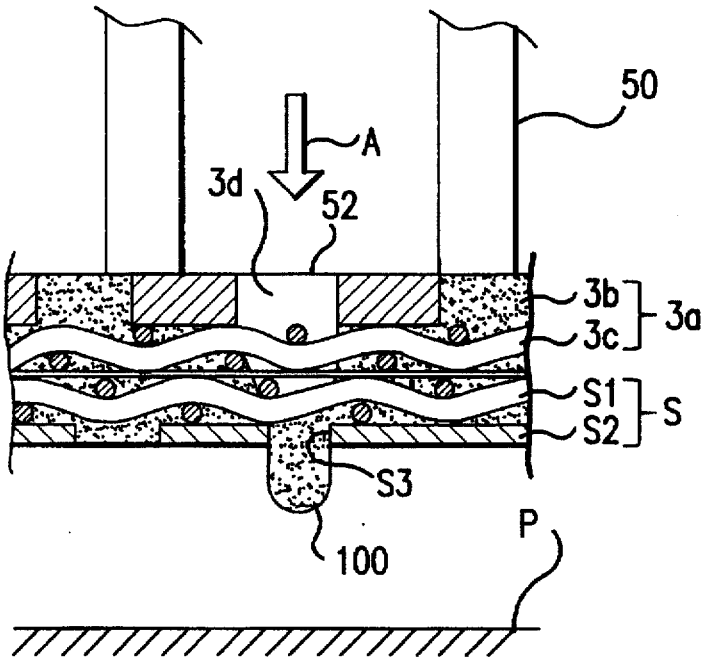
FIG. 10 is a sectional view showing an ink ejecting operation of the air nozzle in the first embodiment.
Figure 11:
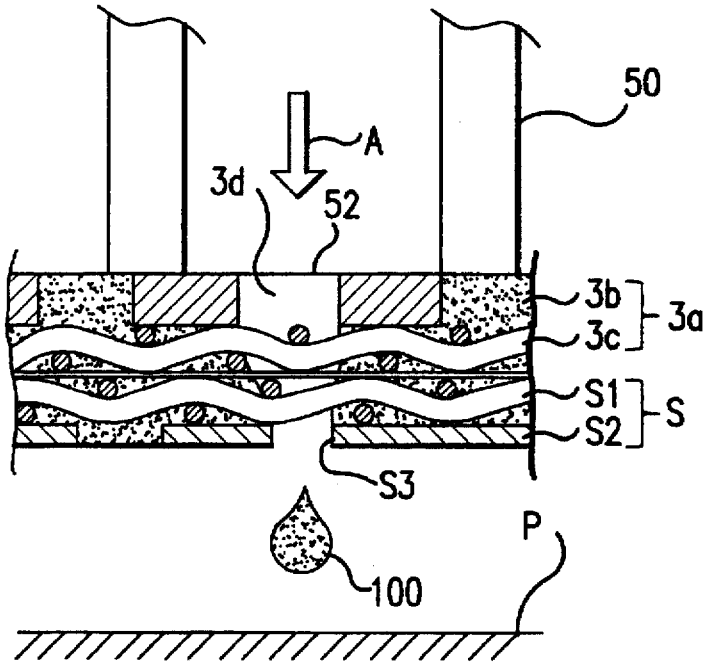
FIG. 11 is a sectional view showing an ink ejecting operation of the air nozzle in the first embodiment.
Figure 12:
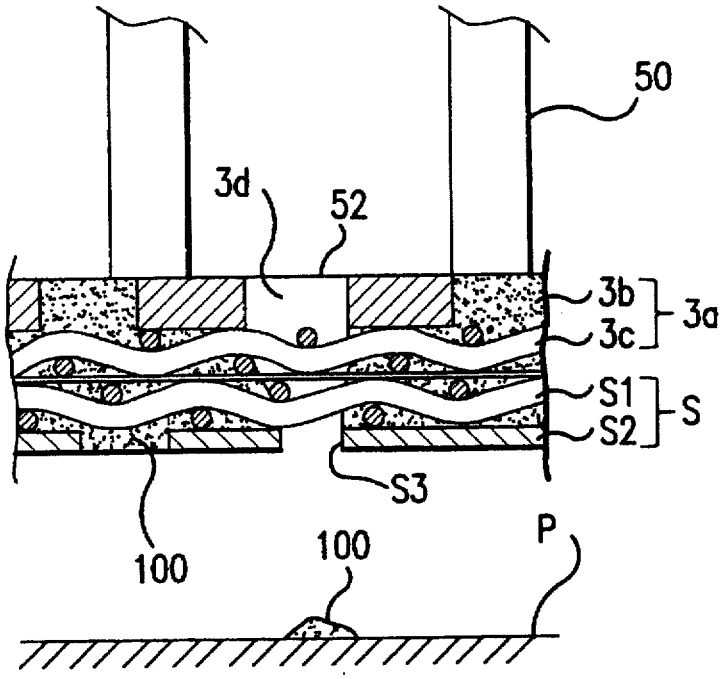
FIG. 12 is a sectional view showing an ink ejecting operation of the air nozzle in the first embodiment.
Figure 13:
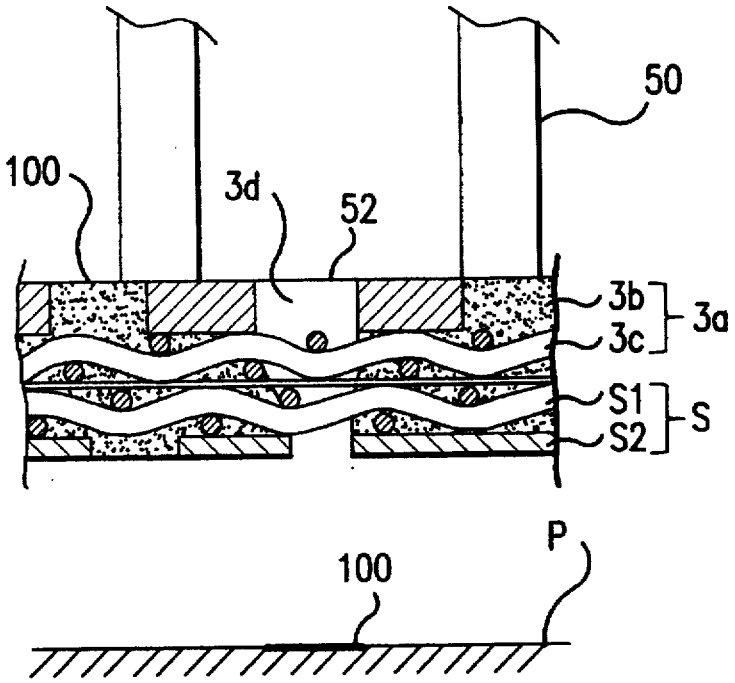
FIG. 13 is a sectional view showing an ink ejecting operation of the air nozzle in the first embodiment.

In printing, the solenoid valve 73 opens at a predetermined timing when the printing drum 3 and the printing sheet P have reached a predetermined position, and a pulsative compressed air is ejected from the air nozzle 50. The compressed air, indicated with arrow A in FIGS. 9 and 10, pushes outward the ink retained in the interior of the circumferential wall 3*a* and that of the stencil sheet S and causes the ink to be ejected out of pores S3 formed in the image portion of the stencil sheet S. The ink 100 present in the pores S3 of the stencil sheet S is forced out under a strong ejection force of the pulsative compressed air. The ink present in the vicinity of pores 3*d* and S3 are held in place by virtue of its own viscosity. Therefore, the amount of ink 100 ejected from the pores S3 is constant. The ejection of pulsative compressed air stops at a predetermined timing, but the ink 100 now in an outwardly projecting state from the stencil sheet S is blown off downward from the stencil sheet as in FIG. 11 and is deposited on a predetermined printing position of the underlying printing sheet P as in FIG. 12. Then, as shown in FIG. 13, the ink 100 thus deposited on the printing sheet P penetrates the interior of the printing sheet and in this way printing at the portion concerned of the printing sheet is completed.

Figures 14A, 14B, 14C:
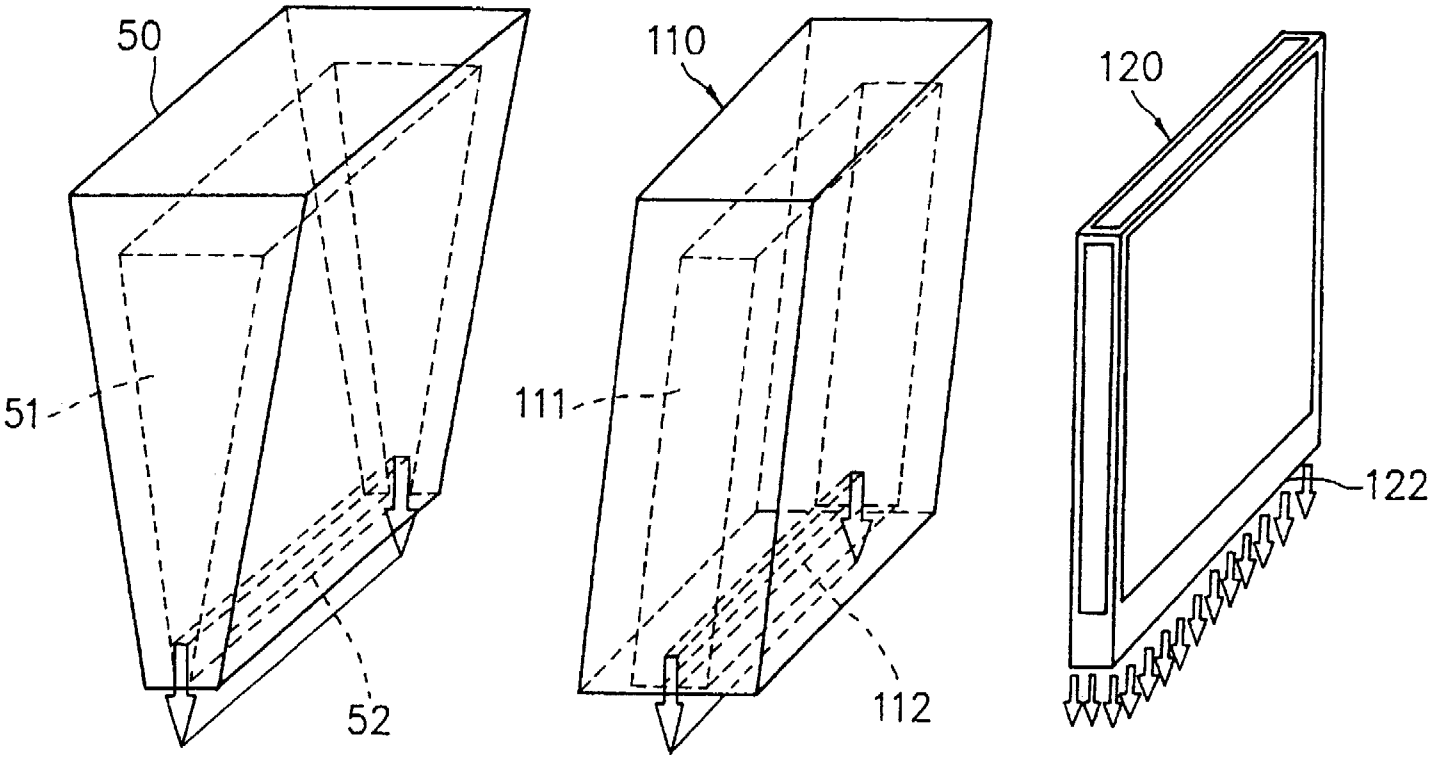
FIG. 14(*a*) is a perspective view of the air nozzle in the first embodiment.

Although the air nozzle 50 used in the first embodiment described above is wedge-shaped as in FIG. 14(*a*), the structure and shape of the air nozzle 50 are not limited to those illustrated in the same figure. For example, there may be used such an air nozzle 110 as shown in FIG. 14(*b*) wherein a slit-like air ejection aperture 112 like that used in the first embodiment is formed in the underside of a generally rectangular parallel piped-shaped box having an air chamber 111. In the air nozzle 111, the bottom plate of the box with the air ejection aperture 112 formed therein is thin, so that the inner surface of the air ejection aperture 112 to which ink adheres is narrow in its surface area. In contrast therewith, the air ejection aperture 52 of the air nozzle 50 used in the first embodiment is in a sandwiched fashion by two side plates, so that the inner surface of the air ejection aperture 52 is wide and ink adheres thereto easily. Thus, in the air nozzle shown in FIG. 14(*b*), as compared with the air nozzle used in the first embodiment, ink is difficult to adhere, thus permitting smooth ejection of air. However, in comparison with the air nozzle 110 shown in FIG. 14(*b*), the air nozzle used in the first embodiment is advantageous in that the area of the bottom contacting the circumferential wall 3*a* is relatively small and hence the resistance to the rotation of the same wall is low.

FIG. 14(*c*) illustrates an air nozzle 120 formed of a porous material according to the third embodiment. The air nozzle 120 is in the form of a thin plate. Compressed air is supplied from the upper end face of the nozzle and is discharged from the lower end face thereof. Since such air nozzles 50 and 110 as illustrated in FIGS. 14(*a*) and (*b*) have continuous slit-shaped air ejection apertures 52 and 112, respectively, it is not always easy to eject air at a constant pressure throughout the overall length of each of such air ejection apertures. But an air ejection aperture 122 of the air nozzle 120 shown in FIG. 14(*c*) is constituted by a large number of pores appearing in the section of the porous material, so even in the event a certain number of such pores is clogged, the other pores are difficult to be affected and it is relatively easy to eject air always at a constant pressure throughout the overall length of the elongated, slit-like air ejection aperture 122.

There also may be used an air nozzle formed with an air ejection aperture comprising a large number of regularly arranged pores of a predetermined shape. For example, circular or elliptical pores may be arranged in a zigzag fashion in the direction perpendicular to the moving direction of the circumferential wall 3*a* to constitute an air ejection aperture. Such a regular and zigzag arrangement of pores of a predetermined shape is difficult to flaw the inner surface of the circumferential wall 3*a* in comparison with the continuous, slit-like air ejection aperture whose long edge portion is apt to flaw the inner surface of the circumferential wall 3*a*.

Figure 15:
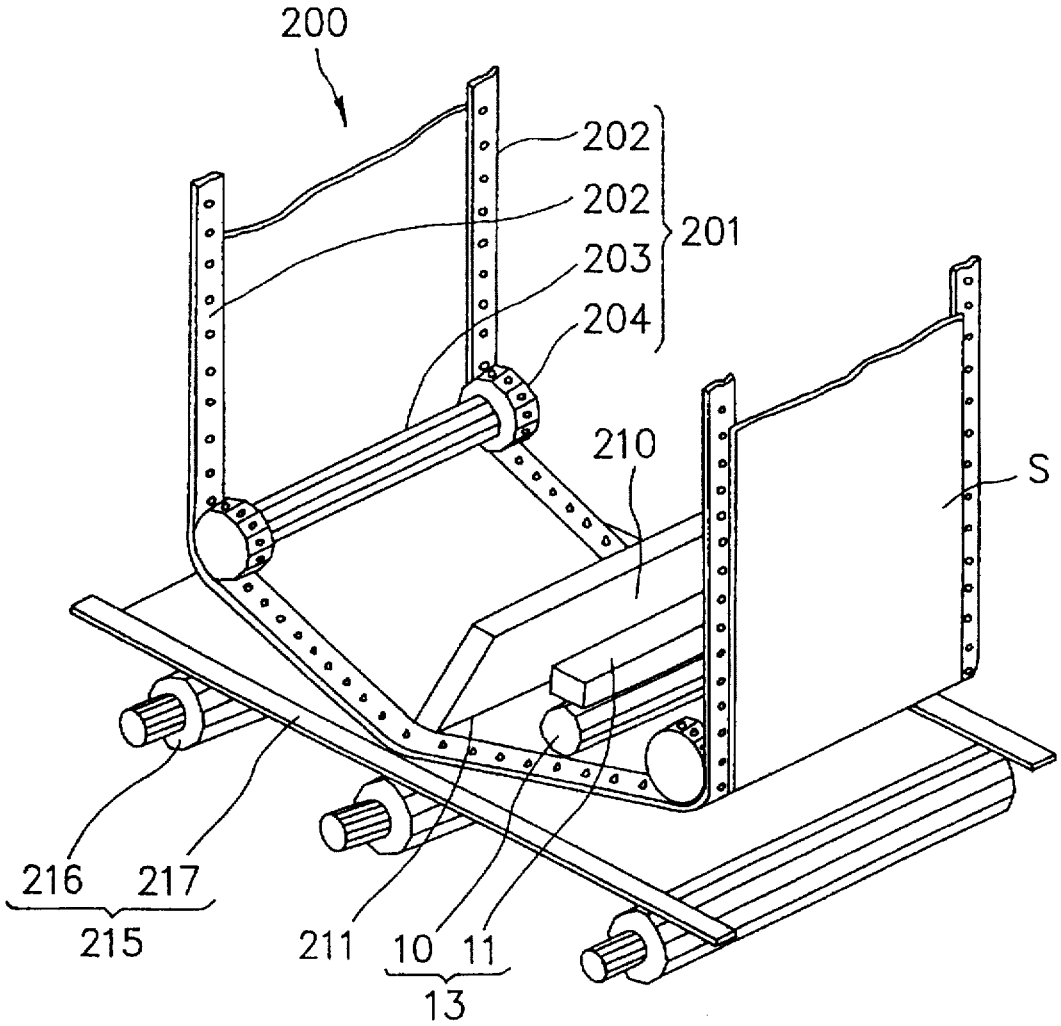
FIG. 15 is a perspective view of the fourth embodiment.

Description is now directed to a stencil printing machine 200 of the fourth embodiment with reference to FIG. 15. A holding means 201 for stencil sheet S in this embodiment has a pair of annular belts 202, 202. Both belts 202, 202 are disposed in two planes parallel to each other and are each engaged with four sprockets 204 mounted on one ends of four common shafts 203. The four shafts 203 are driven by a drive means (not shown) and both belts 202, 202 move in the same direction in a synchronized manner.

A band-like stencil sheet S delivered from a roll (not shown) of stencil sheet is perforated by a stencil making means (not shown) and is fixed to the outer surface side of the paired belts 202, 202 longitudinally of the belts by a fixing means (not shown). As the belts 202, 202 move in a predetermined direction, the stencil sheet S also move together with the belts.

Figure 16:
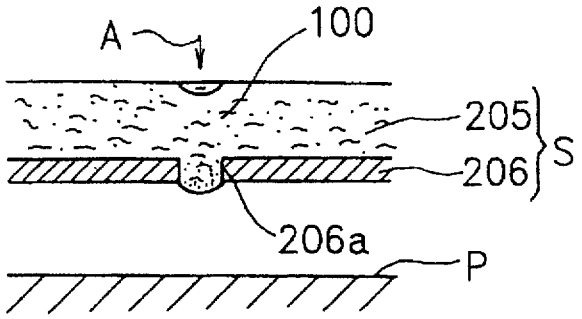
FIG. 16 is a sectional view showing ink ejecting operations in the fourth embodiment.
Figure 16:
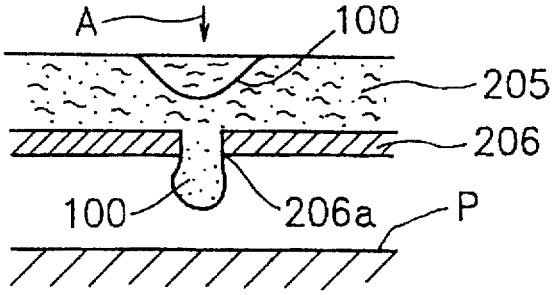
Figure 16:
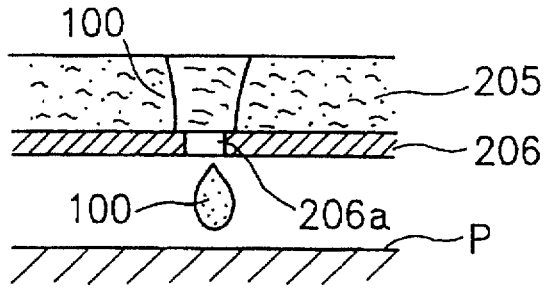
Figure 16:
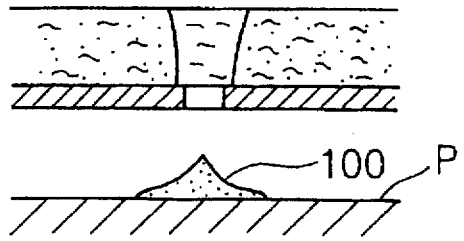
Figure 16:
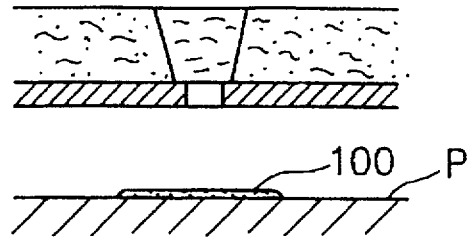

As shown in FIG. 16(*a*), the stencil sheet S used in this embodiment comprises a Japanese paper 205 as a porous substrate and a photosensitive resin film 206 laminated thereto. In the photosensitive resin film 206 is formed an image portion which comprises a large number of fine pores 206*a*. Ink 100, which is retained in the paper 205, is pushed or forced out of the pores 206*a* in the image portion onto a printing sheet P to effect printing.

Inside the annular belts 202 and the stencil sheet S which is mounted to the belts 202 and moves together with the belts, there is disposed an ink supply means 13 for the supply of ink 100 to the stencil sheet S. The ink supply means 13 supplies the ink 100 from the inner surface side of the stencil sheet S fixed to the belts 202.

Inside the annular belts 202 and the stencil sheet S attached to the belts and moving together with the belts there also is disposed an air nozzle 210 as an air ejection means. As the air nozzle 210 there may be used a nozzle of the same structure as any of the air nozzles used in the first to the third embodiment. An air ejection aperture 211 of the air nozzle 210 is in contact with the inner surface of the stencil sheet S moving together with the belts 202. The air nozzle 210 blows off a pulsative compressed air toward the inner surface of the stencil sheet S, thereby causing the ink 100 retained in the stencil sheet to be blown off outward from a large number of fine pores 206*a* which constitute an image portion.

Outside the annular belts 202 and the stencil sheet S attached to the belts and moving together with the belts there is disposed a printing sheet conveying means 215 at a predetermined spacing from the stencil sheet S. The printing sheet conveying means 215 has a plurality of conveyance rollers 16 arranged side by side and adapted to rotate synchronously, and a pair of guide members 217 disposed above the rollers 216. The printing sheet P is held between the conveyance rollers 216 and the guide member 217 and is conveyed in a predetermined direction by virtue of rotation of the conveyance rollers 216. Since both edge portions of the printing sheet P are held by both guide members 217 and conveyance rollers 216, the spacing between the printing sheet P and the stencil sheet S is always kept constant.

The stencil sheet S having subjected to perforation is attached to the paired belts 202, 202. Then, the sprockets 204 are driven to rotate the belts 202, so that the stencil sheet S attached to the belts 202 moves together with the belts. Under the stencil sheet S, the printing sheet P is moved in synchronism with the movement of the stencil sheet.

The ink supply means 13 supplies ink 100 to the inner surface of the stencil sheet S. The viscosity of the ink 100 is set at a value at which the ink retained in the Japanese paper 205 of the stencil sheet S does not naturally flow out of the pores 206*a* of the photosensitive resin film 206 but can move only in the direction of pressure when pressure is applied thereto. In synchronism with the movement of the stencil sheet S and the supply of the printing paper P the air nozzle 210 ejects such a pulsative compressed air to the inner surface of the stencil sheet as indicated with arrow A in FIG. 16(*a*).

As shown in FIG. 16(*b*), the ink 100 present within the Japanese paper 205 sinks upon ejection of the compressed air, and only the ink 100 present substantially just above each pore 206*a* of the perforated film 206 is forced out from the pore 206*a*.

As shown in FIG. 16(*c*), the ink 100 thus forced out from the pore 206*a* is blown off to the outside of the stencil sheet S. At the portion adjacent to the pore 206*a* in the interior of the Japanese paper 205 the amount of ink 100 decreases by an amount corresponding to the amount of ink which has been forced out of the pore. But the ink retained in the surrounding portion in the interior of the paper 205 does not flow into the ink-diminished region overlying the pore 206*a*. Thus, the amount of ink 100 forced out from the stencil sheet S by a single ejection of compressed air is kept constant.

As shown in FIG. 16(*d*), the ink 100 which has been blown off to the outside of the stencil sheet S is deposited on the printing sheet P. Then, as shown in FIG. 16(*e*), the ink 100 thus deposited on the printing sheet P permeates the printing sheet and in this way printing of the portion concerned of the printing sheet is completed.

Although in the fourth embodiment the stencil sheet S is held directly by the paired belts 202, 202, an ink-permeable body such as a mesh sheet may be attached to the paired belts 202, 202. In this case, the stencil sheet S is held removably on the outer side of the said body and ink is supplied from the inner surface side of the body.

Figure 17:
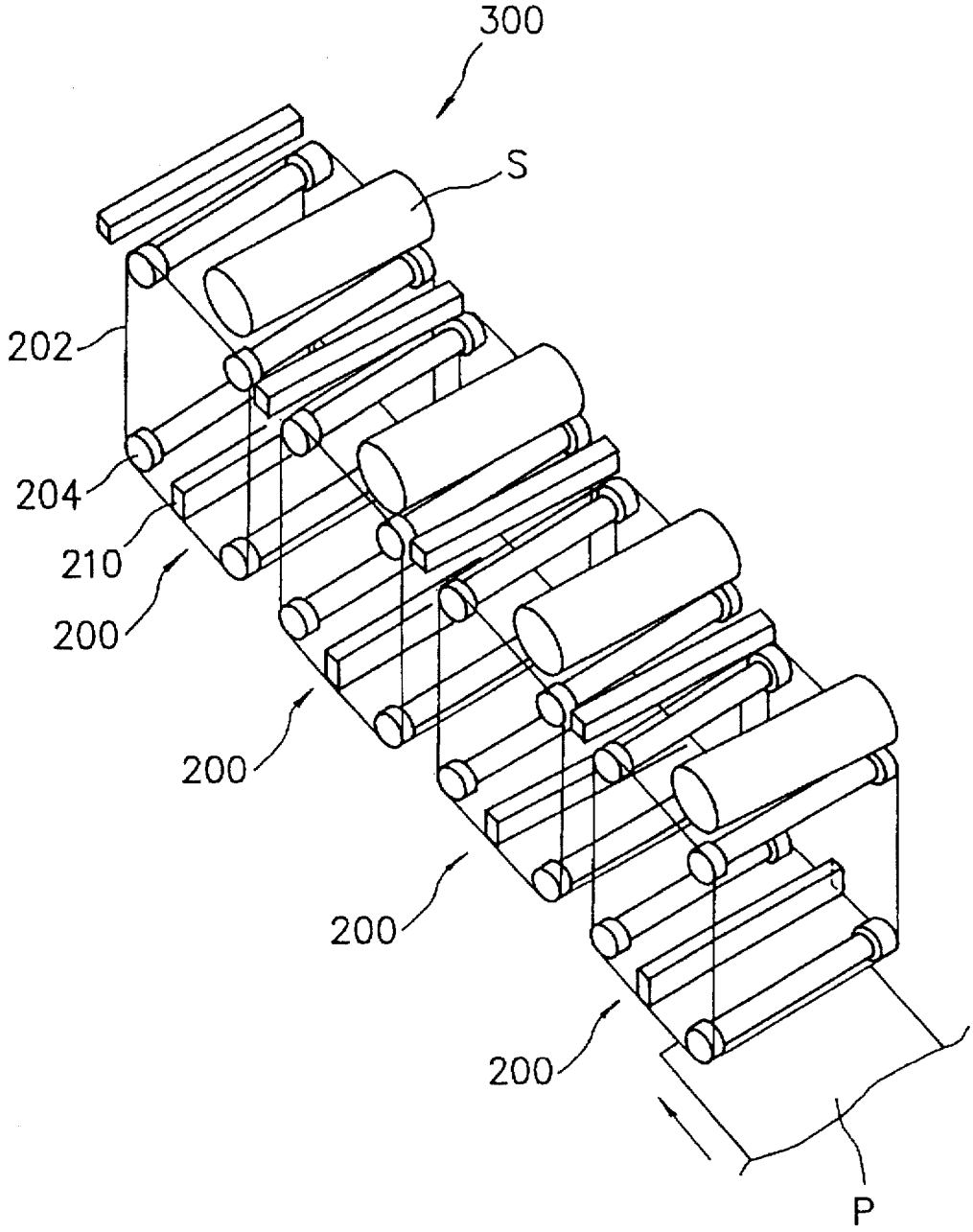
FIG. 17 is a perspective view of the fifth embodiment.

A stencil printing machine of the fifth embodiment will now be described with reference to FIG. 17. This stencil printing machine, indicated at 300, is constituted by an arrangement of four stencil printing machines 200 of the fourth embodiment illustrated in FIG. 15. The four stencil printing machines 200 perform printing using inks of yellow, magenta, cyan and black, respectively, and they are provided with stencil sheets S having perforated images corresponding to the printing colors, respectively. Printing sheet P is conveyed to the four stencil printing machines 200 successively by a stencil sheet conveying means. Images of the colors are formed overlappedly in the stencil printing machines 200, with the result that a full-color image is formed on the printing sheet P.

In each stencil printing machine 200, like the printing machine of the fourth embodiment, ink is blown off by compressed air and adheres to the printing sheet P. Thus, printing is performed in a non-contact manner for the printing sheet P. Therefore, even if printing is performed for a single printing sheet P continuously with four colors of inks, there is no fear that the ink applied to the printing sheet P in a previous step will be retransferred to the stencil sheet S in a subsequent step. Consequently, it is possible to avoid the inconvenient mixing phenomenon of color inks and hence possible to effect a full-color printing of a high grade.

According to the stencil printing machine of the present invention, compressed air is ejected to a stencil sheet held by a holding means to blow off ink retained in the stencil sheet, thereby performing printing in a non-contact manner. Therefore, when ink transfers from the stencil sheet to the printing sheet in stencil printing according to the present invention, there is not applied any unnecessary force to the surface to be printed of the printing sheet and hence it is possible to obtain a print of a beautiful finish. Particularly, the present invention is suitable for multicolor printing and can effect a full-color printing of a high grade.

What is claimed is:

1. A stencil printing machine comprising:

holding means for holding a stencil sheet having a printing area with an image perforated in accordance with an image to be formed;

ink supply means for supplying ink to one face side of the stencil sheet held by said holding means;

printing sheet conveying means for conveying a printing sheet in a predetermined direction on an opposite face side of the stencil sheet;

pulsative compressed air generating means for providing pulsative compressed air; and air ejection means connected to the pulsative compressed air generating means, said air ejection means ejecting the pulsative compressed air from said one face side to the stencil sheet when the printing area of the stencil sheet passes under the ejection means, thereby causing the ink to pass through said image in the stencil sheet and transfer onto the printing sheet.

2. A stencil printing machine according to claim 1, wherein said holding means has an ink-permeable body adapted to come into contact with said one face side of the stencil sheet to hold the stencil sheet and at the same time move in a predetermined direction.

3. A stencil printing machine according to claim 2, wherein said body is a cylindrical, circumferential wall at least a part of which has ink permeability, and said holding means is a printing drum having said circumferential wall and adapted to be driven for rotation about the axis thereof.

4. A stencil printing machine according to claim 2, wherein said air ejection means has an air ejection aperture which is in contact with the inner surface of said body.

5. A stencil printing machine according to claim 4, wherein said air ejection aperture is a slit substantially parallel to the moving direction of said body, and the width thereof in the direction substantially perpendicular to the moving direction of the body larger than the diameter of each of pores which constitute the image in the stencil sheet.

6. A stencil printing machine according to claim 2, further comprising suction means disposed near the opposite face side of the stencil sheet held by said holding means, said suction means sucking the printing sheet being conveyed by said printing sheet conveying means to create a predetermined spacing between the printing sheet and the stencil sheet.

7. A stencil printing machine according to claim 6, further comprising air compressor means which supplies compressed air to said air ejection means through said pulsative compressed air generating means and which sucks air from said suction means.

8. A stencil printing machine according to claim 7, wherein said pulsative compressed air generating means is provided with a rotating disc having slits communicating with said air compressor means and also provided with a fixed disc which is in contact with said rotating disc and which has slits communicating with said air ejection means.

9. A stencil printing machine comprising:

a pair of belts disposed movably at a predetermined spacing from each other for holding and conveying a stencil sheet having a printing area with an image perforated in accordance with an image to be formed;

ink supply means for supplying ink to one face of the stencil sheet held by said belts;

printing sheet conveying means for conveying a printing sheet in a predetermined direction near an opposite face side of the stencil sheet;

pulsative compressed air generating means for providing pulsative compressed air; and air ejection means connected to the pulsative compressed air generating means, said air ejection means ejecting the pulsative compressed air to said one face of the stencil sheet when the printing area of the stencil sheet passes under the ejection means, thereby causing the ink to pass through said image in the stencil sheet and transfer onto the printing sheet.

10. A stencil printing machine according to claim 9, further comprising air compressor means which supplies compressed air to said air ejection means through said pulsative compressed air generating means.

11. A stencil printing machine according to claim 10 wherein said pulsative compressed air generating means is provided with a rotating disc having slits communicating with said air compressor means, and a fixed disc which is in contact with said rotating disc and has slits communicating with said air ejection means.

* * * * *